US006461063B1

(12) United States Patent
Miller et al.

(10) Patent No.: US 6,461,063 B1
(45) Date of Patent: Oct. 8, 2002

(54) PC POSTAGE LABEL USABLE FOR ENVELOPES WITH FACING IDENTIFICATION MARKS

(75) Inventors: Christopher Patrick Miller, Alison Viejo; Keith Bussell, Los Angeles, both of CA (US)

(73) Assignee: Stamps.com, Santa Monica, CA (US)

( * ) Notice: Subject to any disclaimer, the term of this patent is extended or adjusted under 35 U.S.C. 154(b) by 0 days.

(21) Appl. No.: 09/540,112

(22) Filed: Mar. 31, 2000

Related U.S. Application Data

(63) Continuation-in-part of application No. 09/439,531, filed on Nov. 12, 1999, now Pat. No. 6,244,763.

(51) Int. Cl.[7] ..... B41J 11/44; B41J 5/30
(52) U.S. Cl. ..... 400/76; 400/70; 400/61
(58) Field of Search ..... 400/76, 70, 61

(56) References Cited

U.S. PATENT DOCUMENTS 5,413,037 A * 5/1995 Auslander et al. ..... 101/9
6,010,156 A * 1/2000 Block ..... 281/2
6,209,920 B1 * 4/2001 Fabel ..... 283/62

OTHER PUBLICATIONS

E–Stamp.com's Internet Postage Starter Kit which includes samples of self–adhesive labels from Avery identified as Postage and Address Labels #2869 and #2866, and labels for template #2859, available around 1999, exact date uncertain.

* cited by examiner

*Primary Examiner*—Andrew H. Hirshfeld
*Assistant Examiner*—Charles H. Nolan, Jr.
(74) *Attorney, Agent, or Firm*—Christie, Parker & Hale, LLP

(57) ABSTRACT

A sheet having at least one self-adhesive special purpose label arrangement set having a postage indicia label, and preferably a sender label and also preferably an addressee label, and a process for printing these special purpose label arrangement sets. The postage indicia label printed by the process is sized and shaped so that it can be applied to a variety of mail pieces, including mail pieces that have FIM patterns, and the printed postage indicia label can be applied to an upper right hand corner of a mail piece without encroaching on the FIM pattern. The invention also provides a process for printing the self-adhesive special purpose label arrangement set with postage indicia, sender information, and addressee information.

33 Claims, 9 Drawing Sheets

PC POSTAGE LABEL USABLE FOR ENVELOPES WITH FACING IDENTIFICATION MARKS

CROSS-REFERENCE TO RELATED APPLICATION

This is a continuation-in-part application of application Ser. No. 09/439,531, filed on Nov. 12, 1999 now U.S. Pat. No. 6,244,763 which is incorporated by reference herein.

BACKGROUND OF THE INVENTION

This invention is in the field of labels, and more particularly is a special purpose label arrangement set for use in PC postage that can be used with envelopes bearing facing identification marks, and a method for printing this special purpose label arrangement with the necessary information.

SUMMARY OF THE INVENTION

The United States Postal Service (USPS) has responded to recent technological developments in the telecommunication and computer field by developing its Information Based Indicia Program (IBIP.) The IBIP involves the development of new technology to produce new forms of postage. In so-called PC Postage, a user can purchase postage credit, and print the postage in the form of PC Postage onto a label or directly onto the mail piece. The PC Postage includes a human readable portion and a 2-dimensional barcode portion. The human readable portion includes the postage value, mail class, the date, the meter number, optionally a logo, and optionally also the destination zip code (required for business courtesy mail pieces.) The barcode portion is intended to help thwart fraud, and includes information about the mail piece including the destination ZIP code, the amount of postage applied, the date and time the postage was applied, and a digital signature so that the USPS can validate the authenticity of the postage.

In one preferred embodiment of PC Postage, a user will subscribe to a third party central server location, such as Stamps.com (of Santa Monica, Calif.), and by using postage software made available by the central server location, postage value can be downloaded to the user's computer. The user can then print the postage indicia, by an ordinary laser or ink jet printer, directly onto the mail piece itself (onto a standard business envelope), or onto a label to be applied to the mail piece. This postage software works in conjunction with other software programs, such as word processing, accounting, database, and contact management software to allow a user to conveniently print out PC Postage at the same time that addressee and bar code information is printed (and also the sender's return address.)

In order to permit the sophisticated mail handling and optical reading equipment at the USPS to properly interpret the PC Postage and addressee information, it is critical that the postage indicia be applied properly. Indeed, the USPS has established strict guidelines directed to the margins, label sizes, and placement of the Postage Indicia, and the size, placement, and other characteristics of the POSTNET (POStal Numeric Encoding Technique) bar codes, and any facing identification mark (FIM) on mail pieces. These guidelines are contained in the Domestic Mail Manual (DMM) and Title 39, Code of Federal Register (CFR), Part 111, and UPSP Publication No. 25 "Designing Letter Mail".

The various typically available laser and ink jet printers differ in their ability to print close to the edge of sheets of self-adhesive labels fed into the printer, and typically cannot print closer than 0.635 cm (0.25 inch) of each edge of the sheet, although depending on the printer, it can be as much as 1.27 cm (0.5 inch) of each edge of the sheet. In their most common embodiment, these home, office and small laser and ink jet printers are designed to accept sheets having a maximum width of 21.59 cm (8.5 inches), or in the case of wide format printers, about 27.94 cm (11 inches.) However, the majority of the home and office printers are of the 21.59 cm (8.5 inches) variety, and accordingly most self-adhesive labels sheets have a width of 21.59 cm (8.5 inches) or less. To accommodate a variety of printers (and their different print-free margin requirements), most self-adhesive labels are provided on sheets that have relatively wide margins. Unfortunately, formatting self-adhesive labels with overly wide margins reduces the footprint available for the labels and therefore reduces the number and/or size labels that can be provided per sheet.

E-Stamp.com's Internet Postage starter kit includes samples of self-adhesive labels from Avery® identified as Postage & Address Labels #2869 and #2866, and labels for template #2859. These label sheets include the words "Patent Pending". The #2866 labels consist of single enlarged labels with fluorescent strips on the top and right side edges. The #2866 label design is stated as being large enough to print postage and addresses on labels for packages. The #2859 and #2869 labels consist of two labels per set, with fluorescent strips on the top and right side edges of the upper and larger label in each of the two labels per set. The larger upper label in these sets is for the postage indicia, and the smaller label is for the addressee. There is no provision for printing of the sender's address along with the postage indicia label and addressee label. As noted above, the postage indicia includes such information as the destination ZIP code.

A facing identification mark (FIM) is a pattern of vertical bars printed in the upper right area of a mail piece, to the left of the indicia space for a stamp, metering or PC postage. A FIM pattern is essentially a nine-bit code consisting of bars and no-bar place holders (in which the bars corresponding to a binary 1 and no bars correspond to a binary 0.) FIM patterns serves two major purposes. They allow letter that do not contain luminescent stamps of meter imprints (such as business reply mail and official government mail) to be faced (oriented) and canceled (postmarked) by USPS machinery. FIM patterns also permit business reply mail and courtesy reply mail to be separated from other letters and cards for direct processing by optical character readers (OCRs) or barcode sorters (BCSs). This helps in achieving faster processing times.

There are presently four different FIM markings. FIM A is used for courtesy reply mail. FIM B is used for business reply mail, penalty mail, or franked mail without a POSTNET barcode. FIM C is used for business reply mail, penalty mail, or franked mail with a POSTNET barcode. In addition, FIM D is typically used for IBIP mailings, except that a FIM A is required when the FIM is preprinted onto a business courtesy envelope. Notwithstanding which particular FIM pattern is applied, under USPS regulations, there are strict regulations concerning the size and placement of the FIM pattern.

The FIM pattern must be printed in a FIM clear zone, in which no other printing must appear. The FIM clear zone is a rectangular sized zone extending from downwardly 0.625 inches from the upper edge of the mail piece and is located between 3 inches and 1.750 inches from the right side edge. The FIM bars must be 0.625 inch±0.125 inch high and 0.03125 inch±0.008 inch wide. The rightmost bar of the FIM must be 2 inches±0.125 inch from the right edge of the mail piece. The tops of the FIM bars must be no lower than 0.125 inch from the top of mail piece and the bottoms of the FIM bars should touch the bottom edge of the FIM clear zone but must not be more than 0.125 inch above or below that edge.

In view of the presence of FIM patterns on business courtesy mail pieces, which can comprise a relatively large percentage of PC postage users' mailing needs, it would be very useful to have a PC postage label that is designed for use with mail pieces with FIM patterns.

It would be highly useful to have a special purpose Label arrangement that has a label portion for the postage indicia, an addressee label portion, and a sender label portion, so that during the printing of postage indicia onto a self-adhesive label, additional labels for the addressee and sender can also be simultaneously printed by the user, as a set, thereby eliminating the need to print sender labels in a separate step. Furthermore, since some users include additional unique identifying information along with mail pieces, (such as account numbers), which can be placed in the vicinity of the sender's address on the mail piece, it would be beneficial to print all three labels in a single step.

It would also be highly beneficial to have a special purpose label arrangement designed for use with mail pieces that may or may not have a FIM pattern, and that as a minimum has a label portion for the postage indicia, and preferably also an addressee label portion and a sender label portion, so that only a single style of sheets of self-adhesive labels will serve a user's needs during the printing of postage indicia on any mail piece.

It would be convenient to provide a method to permit printing of a special purpose label arrangement that has a label portion for the postage indicia, an addressee label portion, and a sender label portion in a single step, and alternately a special purpose label arrangement that has a label portion for the postage indicia designed for all types of mail pieces, including mail pieces with FIM patterns and preferably also a sender label portion and an addressee label portion.

DETAILED DESCRIPTION OF THE INVENTION

Figure 1:
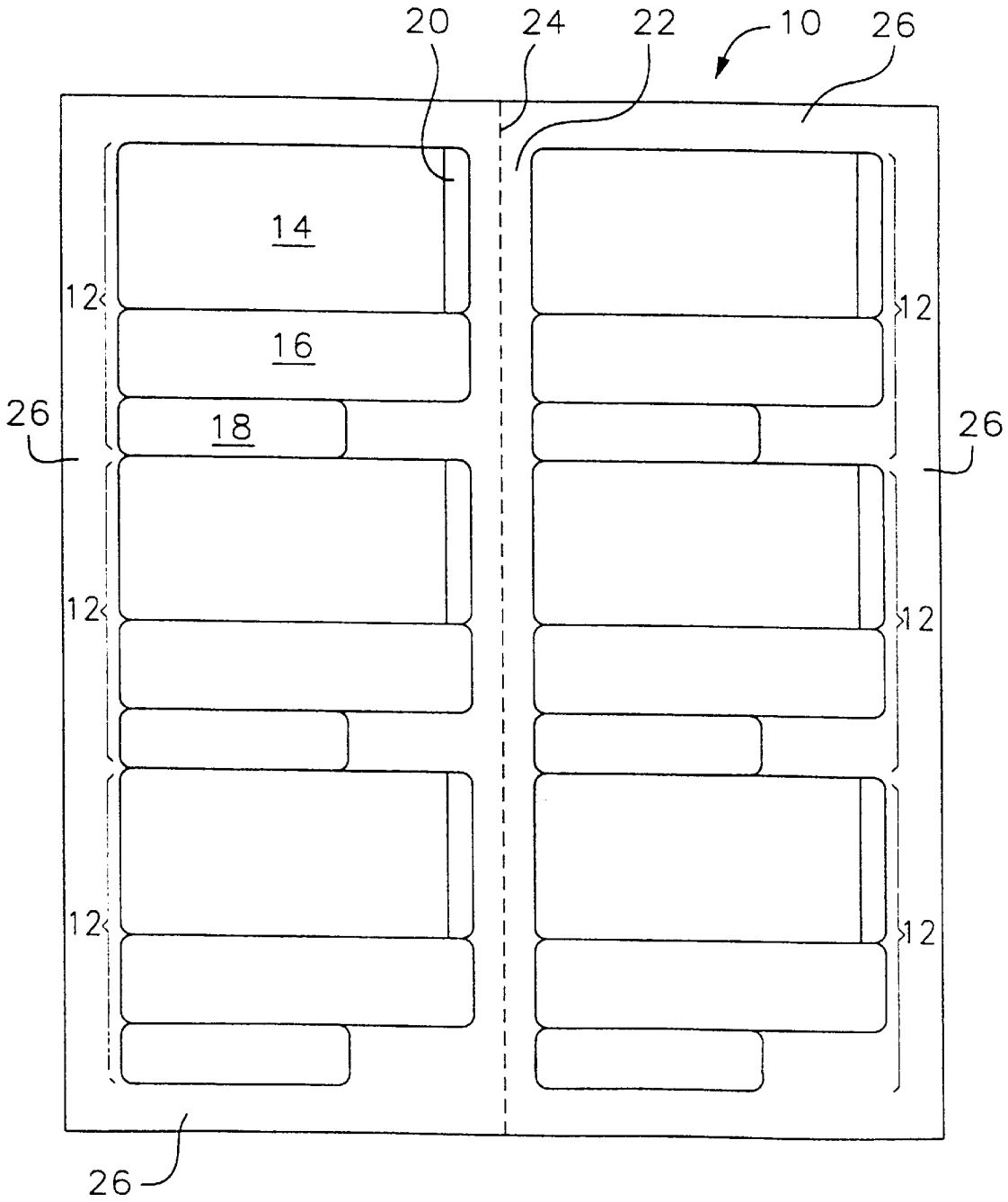
FIG. 1 is a plan view of a first embodiment of a sheet of a plurality of sets of self-adhesive label arrangements of the invention, each set having a label portion for the postage indicia, an addressee label portion, and a sender label portion.

Referring first to FIG. 1, there is shown a plan view of a first embodiment of a single sheet 10 of self-adhesive labels of the invention. In sheet 10, a plurality of label arrangement set 12 are provided. Each label arrangement set 12 has a postage indicia label 14, an addressee label 16, and a sender label 18, arranged to abut each other at their top and bottom edges. These sets are arranged in a portrait orientation on the sheet 10 with the widths of the labels 14, 16 and 18 being parallel to the shorter dimension of sheet 10. Postage indicia label 14 has a fluorescent strip 20 on a right hand edge. The construction of sheet 10 of self-adhesive labels is conventional in that sheet 10 includes a backing sheet (not shown) with low adhesion from which labels 14, 16 and 18 can be detached and then permanently attached to a mailing piece (not shown). Sizing of label arrangement set 12 for an 21.59 cm×cm 27.94 (8.5 inches×11 inches) sheet 10 can preferably be made as follows:

Postage indicia label 14 is about 8.89 cm (3.5 inches) wide and 4.45 cm (1.75 inches) high. Addressee label 16 is about 8.89 cm (3.5 inches) wide and 2.54 cm (1 inch) high. Sender label 18 is about 5.72 cm (2.25 inches) wide and about 1.43 cm (0.5625 inches) high. In FIG. 1, at least one left side edges of labels 14, 16 and 18 are in line, but since addressee label 18 is narrower than postage indicia label 14 and addressee label 16, its position could be shifted (e.g. to be aligned with a right edge of postage indicia label 14 and addressee label 16.) Also, the relative ordering of labels 14, 16 and 18 in set 12 can be shifted (e.g. sender label 18 could be positioned between postage indicia label 14 and addressee label 16) with minor modifications to the software. With the above-noted sizing of labels 14, 16 and 18 in set 12, six sets 12 can be arranged on an 21.54 cm×27.94 cm (8.5 inches×11 inches) sheet, with three label sets 12 on a left hand side and three sets 12 on a right hand side, leaving about a 1.27 cm (0.5 inch) print-free margins 26 on the left, right, top and bottom edges of sheet 10, and optionally with a 1.27 cm (0.5 inch) print-free central dividing area 22 between side-by-side sets 12 on sheet 10. The area on the single sheet 10 excluding the print-free margins 26 comprises a printable footprint areas of the sheet. If desired, a weakened line 24 (e.g. as by a line of micro-perforations) can be formed through central dividing area 22 of sheet 10 and its backing layer that separates side-by-side sets of labels 12 on sheet 10. This feature will allow sheet 10 to be separated into left and right sheet halves if desired, and the separate halves can be separately feed into a printer. As can be seen, the sum of the heights of labels 14, 16 and 18 of the plurality of sets 12 on the left side and right side of the sheet 10 is equal the long dimension of the printable footprint area, and the sum of side-by-side postage indicia labels 14 (and addressee labels 16) plus the width of the optional print-free central dividing area 22 is equal to the shorter dimension of the printable footprint, thereby maximizing the area of the sheet 10 available for the labels 14, 16 and 18.

Figure 2:
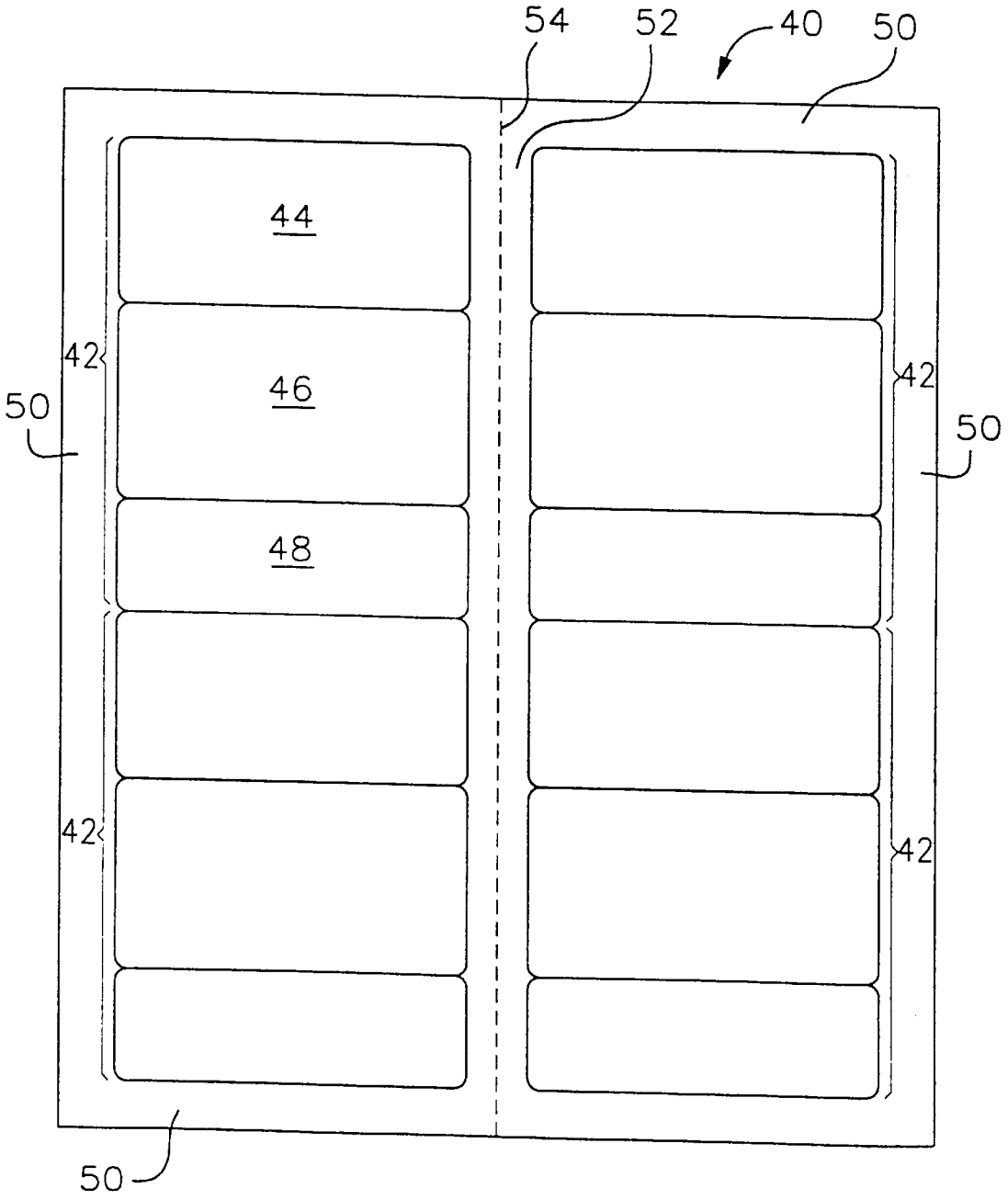
FIG. 2. is a plan view of a second embodiment of a sheet of self-adhesive labels of the invention.

FIG. 2. is a plan view of a second embodiment of a single sheet of self-adhesive labels 40 of the invention which is adapted for non-envelope applications, such as for bulky packages and the like. In sheet 40, a plurality of label arrangement sets 42 are provided and as shown, are in a portrait orientation on sheet with the widths of the labels 44, 46 and 48 being parallel to the shorter dimension of sheet 40. Each set 42 has a postage indicia label 44, an addressee label portion 46, and a sender label 48, arranged to abut each other at their top and bottom edges. Unlike the first embodiment of label sheets 10, under postal regulations, no fluorescent strip need be provided on the postage indicia labels 44. The construction of sheet 40 of self-adhesive labels is conventional in that sheet 40 provides a backing sheet (not shown) with low adhesion from which labels 44, 46 and 48 can be peeled and then permanently attached to a mail piece. Sizing of labels for an 21.54 cm×27.94 cm (8.5 inches×11 inches) sheet can preferably be made as follows:

Postage indicia label 44 is about 8.89 cm (3.5 inches) wide and 4.45 cm (1.75 inches) high. Addressee label 46 is about 8.89 cm (3.5 inches) wide and 5.08 cm (2 inches) high. Sender label 48 is about 8.89 cm (3.5 inches) wide and about 3.81 cm (1.5 inches) high inches high. All labels 44, 46 and 48 have the same width and preferably are aligned with their side edges in line. The relative ordering of labels 44, 46 and 48 in set 42 can be shifted as desired (e.g. label 48 could be positioned between labels 44 and 46.) Sized as noted above, six sets 62 can be arranged on an 21.59 cm×27.94 cm (8.5 inches×11 inches) sheet, with three label sets 42 on a left hand side and three sets 42 on a right hand side, leaving about a 1.27 cm (0.5 inch) wide margins 50 on the left, right, top and bottom edges of sheet 40, and with a 1.27 cm (0.5 inch) central dividing space 52 between side-by-side sets 42 on sheet 40. The area on the single sheet 40 excluding the print-free perimeter margins 50 comprises a printable footprint area of the sheet. If desired, a weakened line 54 (e.g. as by a line of micro-perforations) can be formed through a central dividing area 52 of sheet 10 and its backing layer that separates side-by-side sets of labels 42 on sheet 40. Central dividing area 52 can be about 1.27 cm (0.5 inches) wide (with about 0.635 cm (0.25 inch) of central dividing area 52 on each side of weakened line 54.) This feature will allow sheet 40 to be separated into two halves if desired, and the separate halves can be separately feed into a printer. As can be seen, the sum of the heights of all labels 44, 46 and 48 of the plurality of sets 42 on the left side and right side of single sheet 40 is equal to the longer dimension of the printable footprint area, and the sum of any of the side-by-side postage indicia labels 44 (or addressee labels 46) plus the width optional print-free central dividing area 52 is equal to the shorter dimension of the printable footprint, thereby maximizing the area of sheet 40 available for labels 44, 46 and 48.

Figure 3:
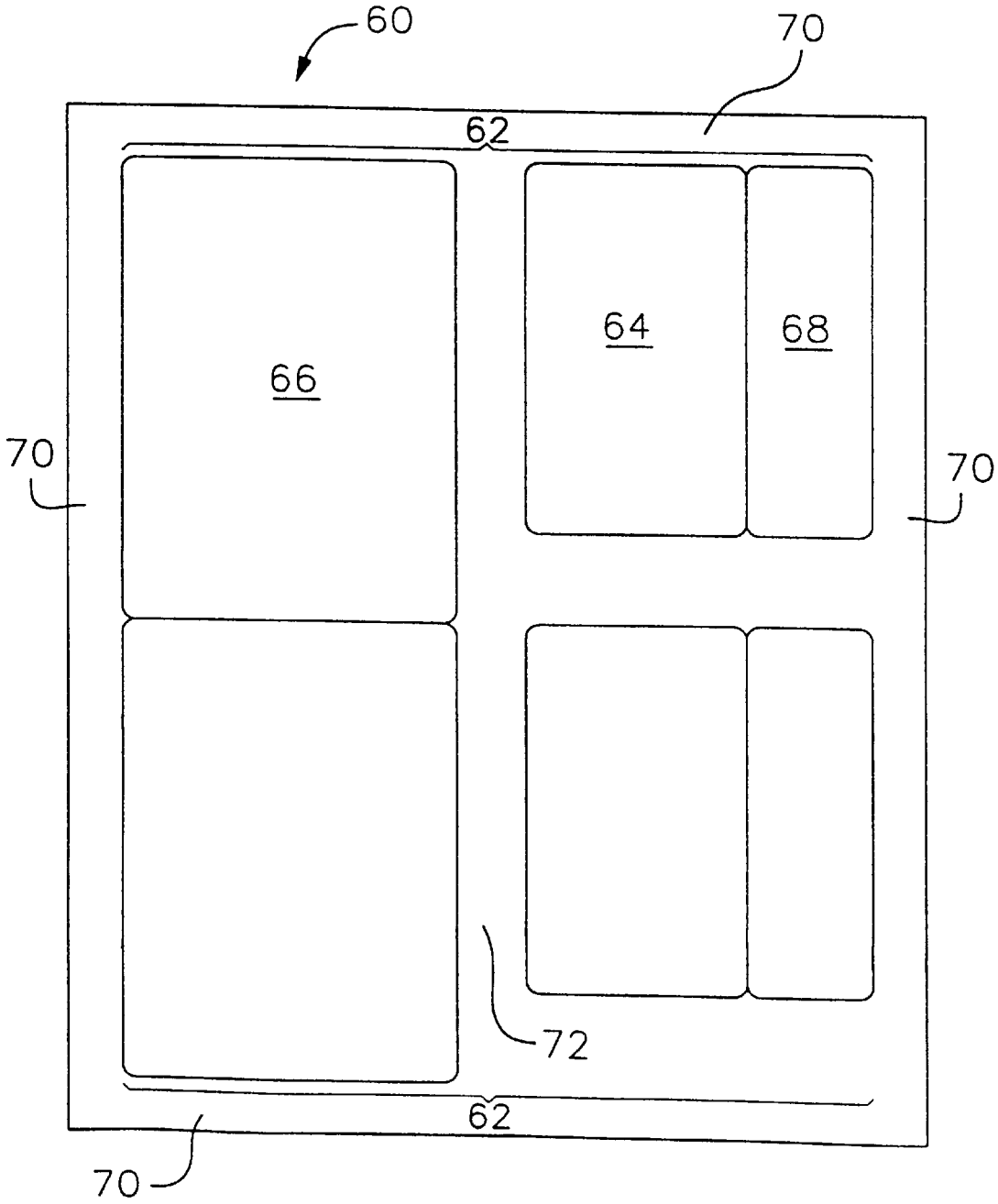
FIG. 3 is a plan view of a third embodiment of a sheet of self-adhesive labels of the invention.

FIG. 3 is a plan view of a third embodiment of a since sheet of self-adhesive labels 60 of the invention. In sheet 60, a plurality (viz. two) label arrangement sets 62 are provided. However, a half-size sheet could also be configured to carry a single label arrangement set if desired (not shown). As shown, the sheet is preferably a standard sized sheet, such as 21.59 cm×29.94 cm (8.5 inches×11 inches), but could be other sizes as well. Label sets 62 are well-suitable for use on large packages and parcels. Each set 62 has a postage indicia label 64, an addressee label 66, and a sender label 68. Unlike the embodiment of FIGS. 1 and 2, each set 62 is arranged on sheet 60 in a landscape orientation, wherein the longer widths of label 64, 66 and 68 are aligned with the longer dimension of sheet 60. In this embodiment, labels 64, 66 and 68 are shown with addressee label 66 on a left hand side of sheet 60, and sender label 68 and postage indicia label 64 on a right hand side of sheet 60.

Sizing of label sets 62 for an 21.59 cm×27.94 cm (8.5 inches×11 inches) sheet can preferably be made as follows: Addressee label portion 66 is about 12.70 cm (5 inches) wide and 8.89 cm (3.5 inches) high. Postage indicia label portion 64 is about 10.16 cm (4 inches) wide and 5.08 cm (2 inches, high. Sender label portion 68 is about 10.16 cm (4 inches) wide and 3.81 cm (1.5 inches) high. The print-free margins 70 around the two set 62 of labels on sheet 60 are preferably a minimum of 1.27 cm (0.5 inches) on the top, bottom, left and right sides. The area on the single sheet 60 excluding the print-free margins 70 comprises a printable footprint area of the single sheet. A central dividing area 72 optionally can run down the center of sheet 60 between labels 66 and 64, or labels 66 and 64 can be positioned to abut each other on a long edge. The relative arrangement of labels 64, 66 and 68 on sheet 60 can be rearranged if desired, (e.g. putting addressee label 66 on a right hand side and labels 64 and 68 on a left hand side, and/or flipping relative positions of labels 64 and 68) so long as the minimum print-free margins of perimeter of sheet 60 are preserved. The sum of the widths of the two side-by-side addressee labels 66 is equal to the longer dimension of the printable footprint area of sheet 60. The sum of the heights of the labels 64, 66 and 68, plus the width of the central dividing area 72 is equal to the shorter dimension of the footprint area.

The above dimensions are all for standard 21.59 cm×27.94 cm (8.5 inches×11 inches) sheets. Other size sheets can be used as well, such as A4 size (21.0 cm×29.7 cm), legal size (21.59 cm×35.6 cm), or smaller sized sheets can be used, with necessary changes being made to the label set sizes, arrangements, and print free margins (so long as minimum required print-free borders are maintained.) Print free margins of about 1.27 cm (0.5 inch) have been found to accommodate the majority of modern computer printers, but other dimensions could be used as well.

The invention also provides a process for printing a special purpose label arrangement set with a postage indicia label, an addressee label and a sender label in a single step.

Figure 4A:
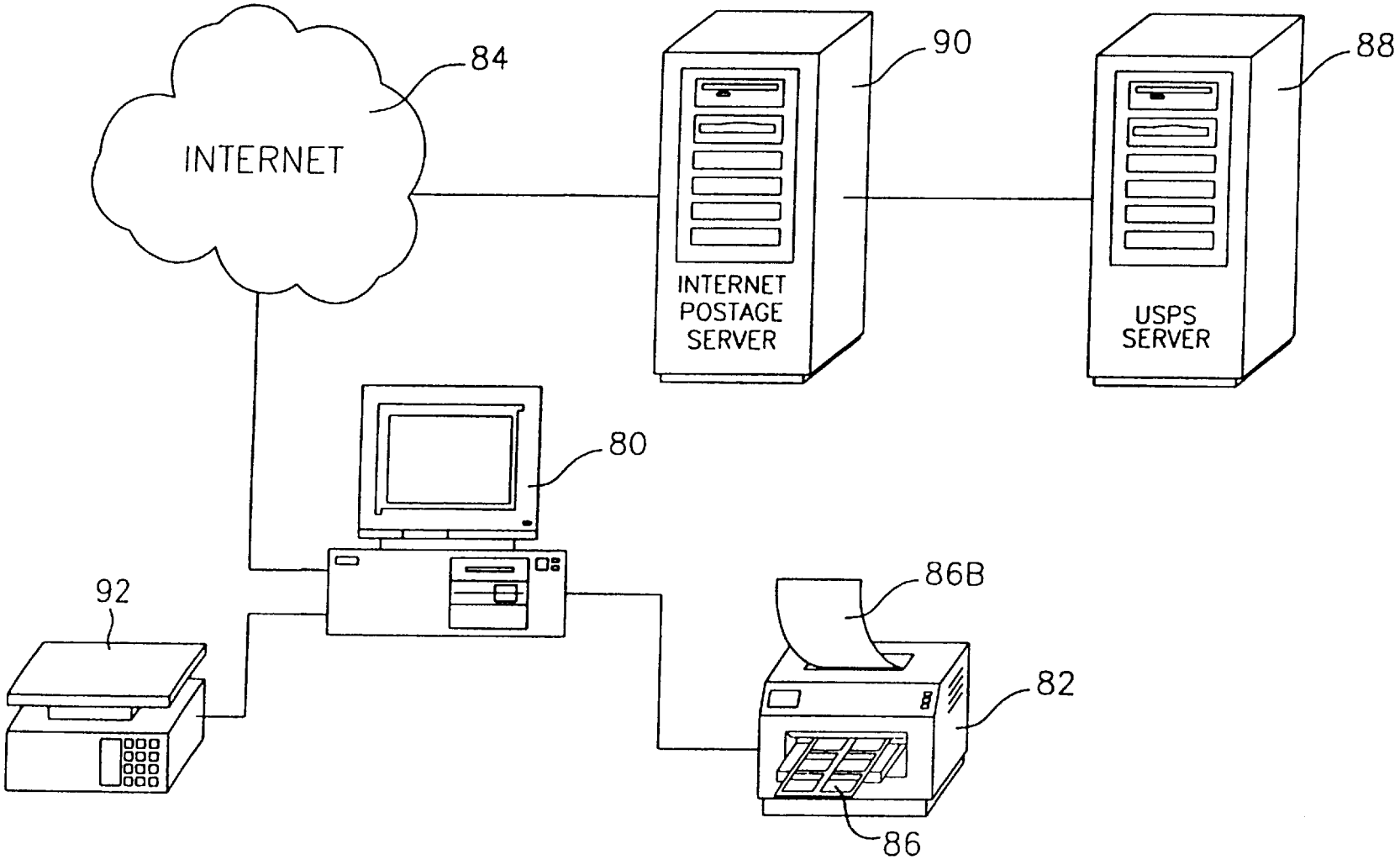
FIG. 4A. is a diagrammatic view showing a first embodiment of a method of the invention wherein a sheet of self-adhesive labels of the invention is being fed into a printer for printing with the postage indicia, addressee, and sender information.

Referring to FIG. 4A, there is depicted a first embodiment of the method, wherein a user will provide a computer system 80 and a printer 82, and computer system 80 is to be connected to the a computer network, such as the Internet 84. A sheet of adhesive labels 86 is provided. Each sheet of labels 86 includes at least one, and preferably a plurality of special purpose label arrangement sets, each set having a postage indicia label, an addressee label, and a sender label. A United States Postal Service Server 88 (or other national postal server for use of the method in foreign countries) is connected to the Internet Postage Server 90, both of which are connected to the Internet 84.

Specialized computer software for printing the postage indicia on the postage indicia label will be provided. For example, computer software such as described in U.S. patent application Ser. No. 09/163,993, filed on Sep. 29, 1998, by Mohan Ananda, entitled "On Line Postage System", assigned to Stamps.com, the assignee of the present invention, is incorporated by reference as if appearing as full herein. This specialized postage computer software program will preferably integrate with other computer software such as word processing, contact management, calendaring database, and accounting programs, to name a few, and will thus allow sharing of information, such as addressee information and account information. Postal value is obtained (e.g. from the Internet.)

This postage value can be obtained in blocks and stored on the user's computer or a device attached to the computer, or can be downloaded as needed (e.g. 33¢ at a time). The user will indicate the style of label sheet being used (e.g. that of FIGS. 1, 2, 3, or some other style of label sheet) and the set number (e.g. top right set) be printed. In another step, the user will input the addresses information (e.g. from a document being typed, from information directly entered into the postage software, from the address book or database of another program, or in some other manner.) The correct postage value for the postage indicia label takes into consideration the sender's address, the destination address, the type of mail service to be used, and the weight and/or size of the postal piece being mailed. An optional electronic scale 92 connected to the computer system 80 can be used to automatically provide the mailing piece's weight. The user may wish to print a return address label, which may be the sender's primary return address or some other address (e.g. an address for billing purposes, an address for customer service, etc.) Other information can also be printed onto the sender's label including, for example, a billing or account code. Some parts of the return address information, or other information identifying the user, such as origin zip code and origin city can be contained on the postage indicia label. Accordingly, there is a considerable amount of coordination required between the different data, the different software, and the label attributes in order to properly print the label sets. The specialized computer program will then direct the printer to print the postage indicia label, the addressee label, and the sender label of the correct set (e.g. the middle left set) of the special purpose label arrangement set, preferably in a single pass through the printer. The ordering of the above described steps is not critical, and could be varied.

Figure 4B:
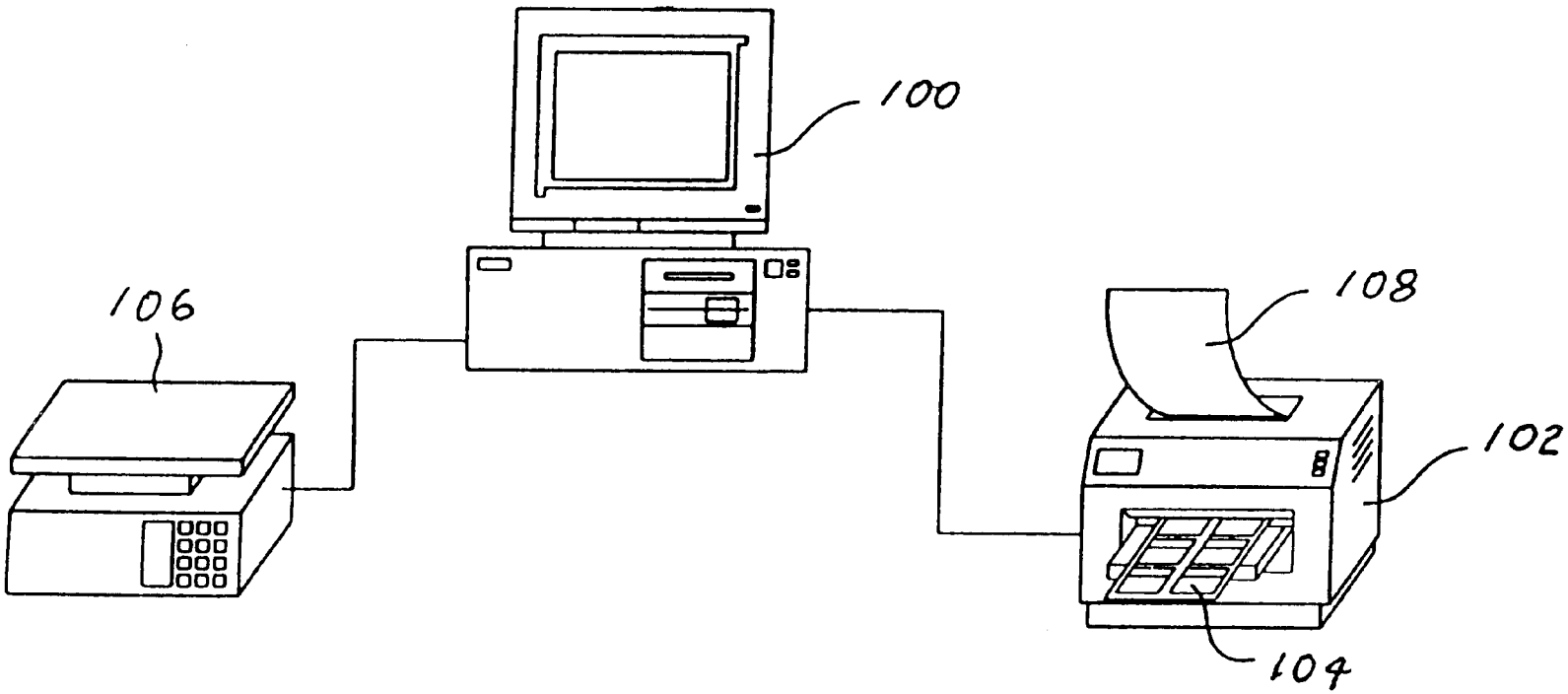
FIG. 4B is a diagrammatic view showing a second embodiment of a method of the invention wherein a sheet of self-adhesive labels of the invention is being fed into a printer for printing with the postage indicia, addressee, and sender information.

Referring now to FIG. 4B, there is depicted a second embodiment of the method, whereas means other than the Internet can be used for obtaining postal value. In this second embodiment, the user will provide a computer system 100 and a printer 102. For example, a local area network or wide area network might be used. Each sheet of labels 104 includes at least one, and preferably a plurality of special purpose label arrangement sets, each set having a postage indicia label, an addressee label, and a sender label.

The postage value can be obtained in blocks and stored on the user's computer or a device attached to the computer, or can be obtained as needed. The user will indicate the style of label sheet being used (e.g. that of FIGS. 1, 2, 3, or some other style of label sheet) and the set number (e.g. top right set) be printed. In another step, the user will input the addresses information (e.g. from a document being typed, from information directly entered into the postage software, from the address book or database of another program, or in some other manner.) The correct postage value for the postage indicia label takes into consideration the sender's address, the destination address, the type of mail service to be used, and the weight and/or size of the postal piece being mailed. An optional electronic scale connected to the computer system 106 can be used to automatically provide the mailing piece's weight. The user may wish to print a return address label, which may be the sender's primary return address or some other address (e.g. an address for billing purposes, an address for customer service, etc.) Other information can also be printed onto the sender's label including, for example, a billing or account code. Some parts of the return address information, or other information identifying the user, such as origin zip code and origin city can be contained on the postage indicia label. Accordingly, there is a considerable amount of coordination required between the different data, the different software, and the label attributes in order to properly print the label sets. The computer program will then direct the printer to print the postage indicia label, the addressee label, and the sender label of the correct set (e.g. the middle left set) of the special purpose label arrangement set to form completed label set 108, which may preferably occur in a single pass through printer 102. The ordering of the above described steps is not critical, and could be varied.

Figure 5:
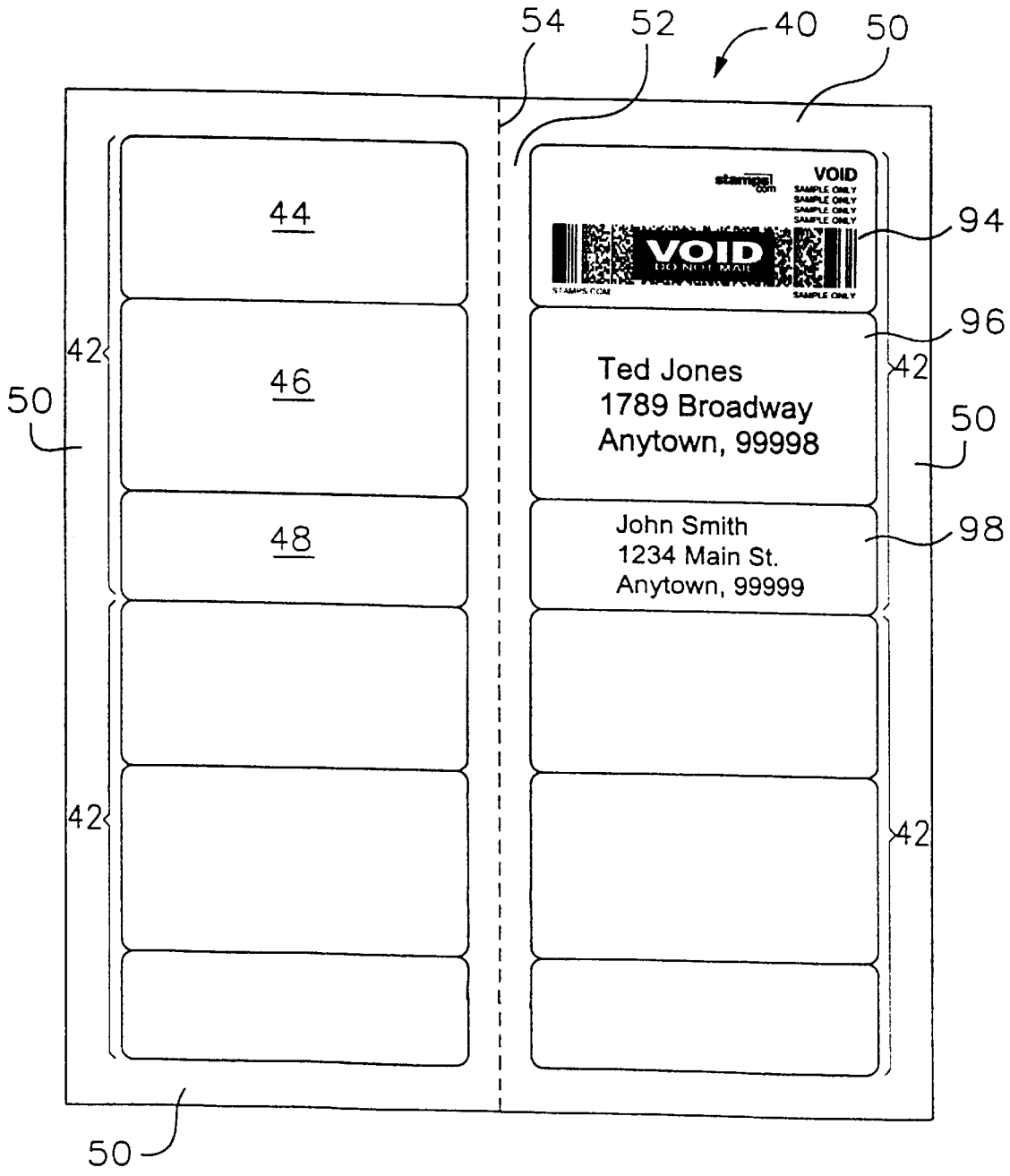
FIG. 5. is a top plan view showing a sheet of self-adhesive labels of the invention after one set of the three labels in the set is printed with the postage indicia. addressee, and sender information.

FIG. 5. is a top plan view showing a sheet of self-adhesive labels 40 of the invention after one set 42 of the three labels 44, 46 and 48 is printed with the postage indicia 94, addressee information 96, and sender information 98. Since set 42 is printed in a single pass through printer 82, the method provides an ideal method to print all labels necessary to send a mail piece with the postage indicia.

Figure 6:
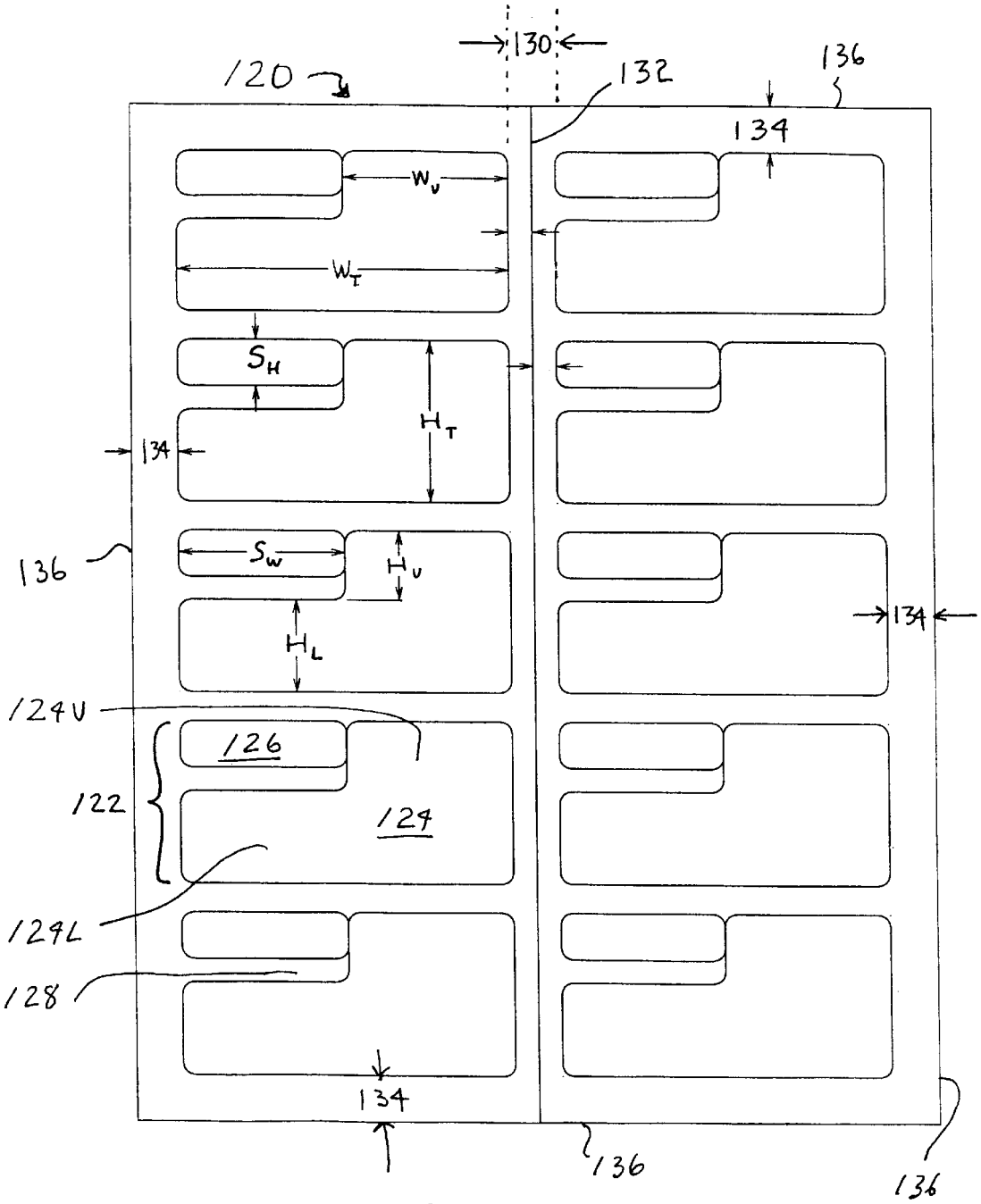
FIG. 6 is a plan view of a fourth embodiment of a sheet of self-adhesive labels of the invention.

FIG. 6 is a plan view of a fourth embodiment of a sheet: of self-adhesive labels 120 of the invention. In sheet 120, a plurality of label arrangement set 122 are provided. Each label arrangement set 122 has a non-rectangular postage indicia label 124 and a sender label 126. The fourth embodiment of the sheet of self-adhesive labels 120 is well-suited to windowed mail pieces (through which the return address will show) or mail pieces that are pre-addressed to the addressee. Unlike the rectangular shapes of the first through third embodiments of postage indicia label, in the fourth embodiment, the postage indicia label 124 has a wider lower rectangular section 124L and a narrower upper rectangular section 124U, with the upper rectangular section 124U extending above the lower rectangular section 124L on the right hand side, with the result that a relief portion 128 is formed on its upper left hand side of postage indicia label 124.

The sizing of label arrangement set 122 for an 21.59 cm×cm 27.94 (8.5 inches×11 inches) sheet 120 can preferably be made as follows to maximize the number of labels on a sheet, yet provide sufficient printing area.

Postage indicia label 124 has a total width $W_T$ of about 8.89 cm (3.5 inches) and a total height $H_T$ of 4.45 cm (1.75 inches). The wider lower rectangular section 124L is about 8.89 cm (3.5 inches) wide $W_L$ and about 2.54 cm (1.00 inches). high $H_L$, and the narrower upper rectangular section 124U is about 4.45 cm (1.75 inches) wide $W_U$ and about 1.91 cm (0.75 inches) high $H_U$, again with the total height $H_T$ being about 4.45 cm (1.75 inches). The sender label 126 is about 4.45 cm. (1.75 inches) wide $S_W$ and about 1.27 cm (0.5 inch) high $S_H$, and can be positioned in relief portion 128 with the right edge of sender label 126 contacting the left edge of the upper rectangular section 124U.

The fourth embodiment of a sheet of self-adhesive labels 120 shows ten sets of label arrangement set 122, with five sets on a left hand side and five sets on a right hand side of a sheet. A central dividing area 130 is about 1.27 cm (0.5 inch) wide with the postage indicia label 124 and the sender label 126 each positioned about 0.635 cm (0.25 inch) away from a center line 132. Print-free margin regions 134 adjacent to the edges 136 of the sheet 120 are provided, and are preferably sized to be about 0.635 cm to 1.27 cm (0.025 to 0.5 inch) wide, and surround the label sets 122. The area on the sheet 120 excluding the print-free margins 134 comprises a printable footprint areas of the sheet 120.

Figure 7:
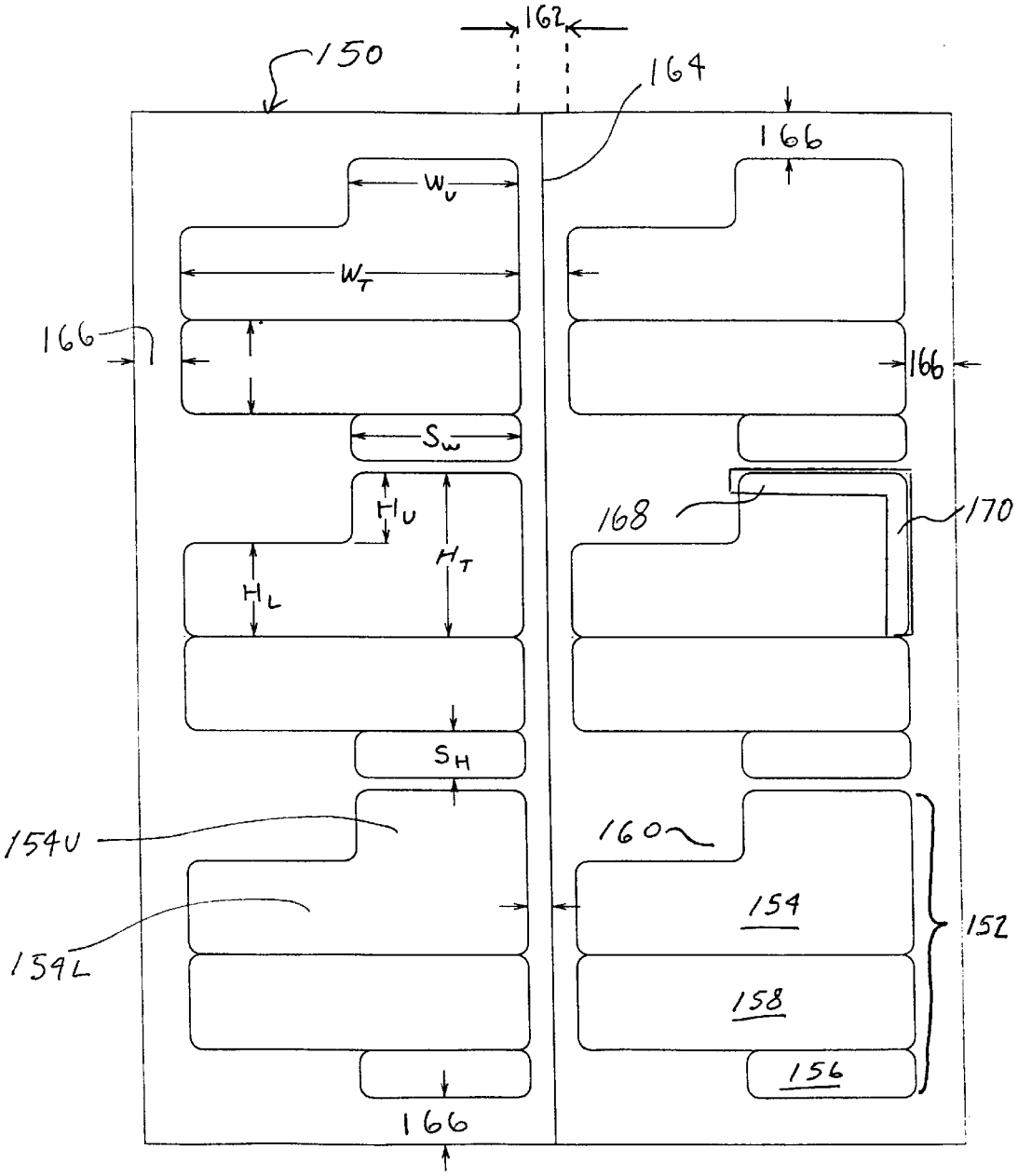
FIG. 7 is a plan view of a fifth embodiment of a sheet of self-adhesive labels of the invention.

Turning now to FIG. 7, there is shown a fifth embodiment of a sheet of self-adhesive labels 150 of the invention. In the fifth embodiment of a sheet of self-adhesive labels 150, a plurality of label arrangement set 152 are provided. Each label arrangement set 152 has a non-rectangular postage indicia label 154, a sender label 156, and an address label portion 158. As with the fourth embodiment, the postage indicia label 154 has a wider lower rectangular section 154L and a narrower upper rectangular section 154U, with the upper rectangular section 154U extending above the lower rectangular section 154L on the right hand side, with the result that a relief portion 160 is formed on its upper left hand side of postage indicia label 154.

The sizing of label arrangement set 152 for an 21.59 cm×cm 27.94 (8.5 inches×11 inches) sheet 150 can preferably be made as follows.

Postage indicia label 154 has a total width $W_T$ of about 8.89 cm (3.5 inches) and a total height $H_T$ of 4.45 cm (1.75 inches). The wider lower rectangular section 154L is about 8.89 cm (3.5 inches) wide $W_L$ and about 2.54 cm (1.00 inches). high $H_L$, and the smaller upper rectangular section 154U is about 4.45 cm (1.75 inches) wide $W_U$ and about 1.91 cm (0.75 inches) high $H_U$, again with the total height $H_T$ being about 4.45 cm (1.75 inches). The sender label 156 is about 4.45 cm (1.75 inches) wide $S_W$ and about 1.27 cm (0.5 inch) high $S_H$, and can be positioned directly below and adjacent to addressee label portion 158. The addressee label portion 158 is about 4.45 cm (1.75 inches) wide $A_W$ and 2.54 cm (1.00 inch) high $A_H$. Address label portion 158 is preferably positioned on sheet 150 between indicia label portion 154 and sender label portion 156 with its upper edge adjacent to a lower edge of indicia label portion 154 and with a portion of its lower edge adjacent to an upper edge of sender label portion 156.

The fifth embodiment of a sheet of self-adhesive labels 150 shows six sets of label arrangement set 152, with three sets on a left hand side and three sets on a right hand side of a sheet. A central dividing area 162 is about 1.27 cm (0.5 inch) wide with side edge of the postage indicia label 154, the sender label 156, and the addressee label 158 each being Positioned about 0.635 cm (0.25 inch) away from a center line 164. Print-free margin regions 166 adjacent to the edges 168 of the sheet 150 are provided, and are preferably sized Lo be about 0.635 cm to 1.27 cm (0.25 inch to 0.5 inch) wide, and surround the label sets 152. The area on the sheet 150 excluding the print-free margins 1166 comprises a printable footprint area of the sheet 150. Optionally, an upper strip 168 of upper rectangular section 154U and a right side strip 170 of the entire postage indicia label 154 can be printed with phosphorescent or fluorescent ink to further indicate that the mail piece is for automatic processing. Hereinafter, the term "fluorescent" shall be used to refer to both phosphorescent or fluorescent inks. The phosphorescent or fluorescent ink strips 168 and 170 are preferably about 0.79 cm (0.313 inch) wide. For purposes of illustration only, the sheet of self-adhesive labels 150 is shown with a single postage indicia label 154 printed with fluorescent ink strips 168 and 170.

Figure 8:
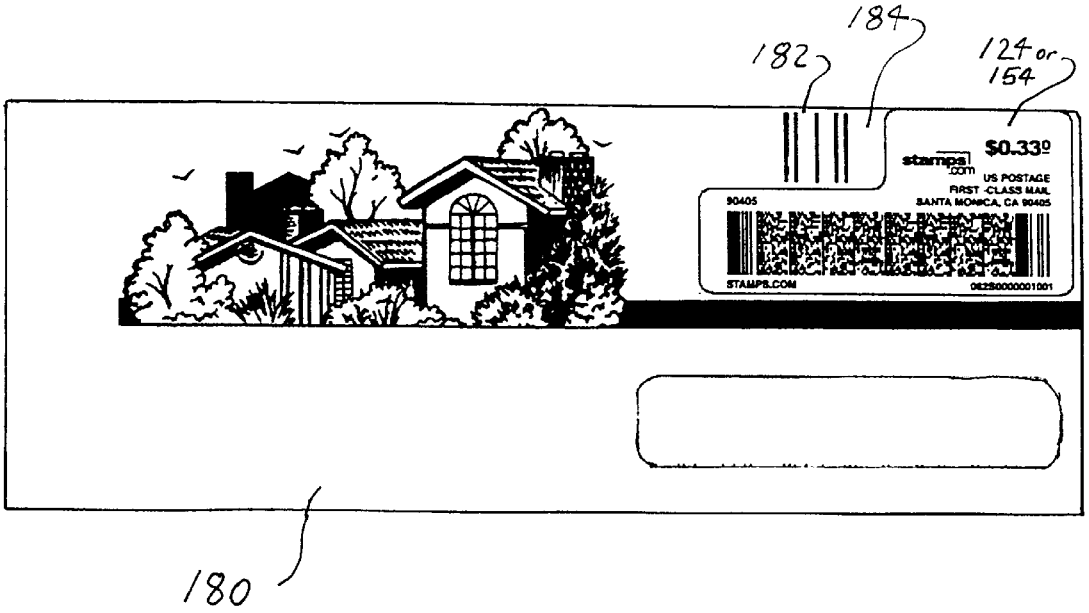
FIG. 8 is a plan view showing the postage indicia label portion printed with indicia and applied to a mail piece with a FIM pattern.

Turning now to FIG. 8, there is shown a plan view of the postage Indicia label portion (124 or 154) printed with indicia and applied to a mail piece 180 with a FIM pattern 182. As shown, the postage indicia label portion (124 or 154) does not impinge on the FIM pattern 182 or the FIM clear zone 184, yet it provides an adequate footprint for printing the postage indicia label portion (124 or 154) with the indicia.

While the fourth and fifth embodiments of the label arrangements sets are shown as including a sender label portion (and an addressee label portion in the case of the fifth embodiment) in addition to the postage indicia label portion, in practice it is possible to produce sheets carrying just the postage indicia label portion. However, without the sender label portion and/or the addressee label portion, a user cannot print each of the postage indicia, the sender's address and the addressee's address in a single pass through the printer. In cases where the fourth or fifth embodiment of the label arrangements label sets are used for non-FIM pastern bearing mailings and/or where a user wishes to have the sender address and the addressee information printed in a single pass, this would mean that all of the user's needs would not be meet with the single label set. Accordingly, the fifth embodiment of a sheet of self-adhesive labels 150 provides the greatest versatility to the user.

The fourth and fifth embodiments of the label sets are printable in a like manner as with the other noted sets of label arrangements, except in cases where no address label is provided, no information concerning the addressee need be accessed (except perhaps for calculation of the postage rates), and in cases where the label sets comprise just a postage indicia label, not all information for the sender label need be retried and printed.

The drawings and the foregoing description are not intended to represent the only form of the invention in regard to the details of this construction and manner of operation. In fact, it will be evident to one skilled in the art Shag modifications and variations may be made without departing from the spirit and scope of the invention. Although specific terms have been employed, they are intended in a generic and descriptive sense only and not for the purpose of limitation.

What is claimed is:

1. A single sheet bearing at least one computer printer printable self-adhesive special purpose label arrangement set for use with a computer system and printer for printing the special purpose label arrangement sets with postage indices and adapted for use on mail pieces including mail pieces bearing FIM patterns, the single sheet comprising:

at least one special purpose label arrangement set, the at least one special purpose label arrangement set having a postage indicia label having a wider lower region and a narrower upper region, the lower and upper regions being continuous, with the upper region and being oriented to a right side of the postage indicia label leaving a relief area on an upper left side area of the postage indicia label, wherein the at least one special purpose label arrangement set is located on a printable footprint area of the single sheet;

wherein the postage indicia label of the special purpose label arrangement set is adapted to be printed with postage indicia and is sized and shaped for attachment to an upper right hand corner of a mail piece bearing FIM patterns and having a FIM clear zone in such a manner so as not to encroach on the FIM pattern.

2. The sheet of claim 1, wherein the single sheet of at least one computer printer printable self-adhesive special purpose label arrangement sets further comprises a sender label.

3. The sheet of claim 2, wherein the sender label is located on the sheet in the relief area.

4. The sheet of claim 2, wherein the single sheet of at least one computer printer printable self-adhesive special purpose label arrangement set further comprises an addressee label.

5. The sheet of claim 4, wherein in each special purpose label arrangement set, the sender label is positioned between the postage indicia label and the addressee label.

6. The sheet of claim 1, wherein the single sheet has a shorter dimension and a longer dimension and a plurality of special purpose label arrangement sets are provided and arranged in a portrait orientation on the single sheet with a plurality of the special purpose label arrangement sets being arranged in a side-by-side orientation on a left side and on a right side of the single sheet.

7. The sheet of claim 4, wherein right side edges of the postage indicia label portion, the addressee label portion, and the sender label portion in each set are aligned.

8. The sheet of claim 1, wherein a top region and a right side region of the postage indicia label of the at least one special purpose label arrangement set are provided pre-printed with phosphorescent ink strips.

9. The single sheet of claim 1, wherein the single sheet is between about 21.0 cm and 21.6 cm wide and between about 27.9 cm and 29.7 cm long, and wherein the print-free areas comprises about at least a 0.635 cm perimeter area around edges of the single sheet, the printable footprint area lying within the print-free areas.

10. A single sheet bearing a least one computer printer printable self-adhesive special purpose label arrangement set for use with a computer system and printer for printing the special purpose label arrangement sets with postage indicia and sender information and adapted for use on mail pieces including mail pieces bearing FIM patterns, the single sheet comprising:

at least one special purpose label arrangement set, the at least one special purpose label arrangement set having a postage indicia label and a sender label, the postage Indicia label having a wider lower region and a narrower upper region, the lower and upper being continuous, with the upper region being oriented to a right side of the postage indicia label leaving a relief area on an upper left side area of the postage indicia label, wherein the at least one special purpose label arrangement set is located on a printable footprint area of the single sheet;

wherein the postage indicia label of the special purpose label arrangement set is adapted to be printed with postage indicia and is sized and shaped for attachment to an upper right hand corner of a mail piece bearing FIM patterns and having a FIM clear zone in such a manner so as not to encroach on the FIM pattern.

11. The sheet of claim 10, wherein the sender label is located on the sheet in the relief area.

12. The sheet of claim 10, wherein the single sheet of at least one computer printer printable self-adhesive special purpose label arrangement set further comprises an addressee label.

13. The sheet of claim 12, wherein in each special purpose label arrangement set, the addressee label is positioned between the postage indicia label and the sender label.

14. The sheet of claim 10, wherein the single sheet has a shorter dimension and a longer dimension and a plurality of special purpose label arrangement sets are provided and arranged in a portrait orientation on the single sheet with a plurality of the special purpose label arrangement sets being arranged in a side-by-side orientation on a left side and on a right side of the single sheet.

15. The sheet of claim 12, wherein right side edges of the postage indicia label portion, the addressee label portion, and the sender label portion in each set are aligned.

16. The sheet of claim 12, wherein a top region and a right side region of the postage indicia label of the at least one special purpose label arrangement set are provided pre-printed with fluorescent ink strips.

17. The single sheet of claim 10, wherein the single sheet is between about 21.0 cm and 21.6 cm wide and between about 27.9 cm and 29.7 cm long, and wherein the print-free areas comprises about at least a 0.635 cm perimeter area around edges of the single sheet, the printable footprint area lying within the print-free areas.

18. A process for printing, in a single step, postage indicia and sender information onto a single sheet containing a plurality of special purpose label arrangement sets, the process comprising:

providing a computer system and a printer;

providing a single sheet of a plurality of computer printable self-adhesive special purpose label arrangement sets, each special purpose label arrangement set having a postage indicia label, an addressee label, and a sender label, the postage indicia label having a wider lower region and a narrower upper region, the lower and upper being continuous, with the upper region being oriented to a right side of the postage indicia label, wherein the special purpose label arrangement sets are located on a printable footprint area of the single sheet;

providing a postage computer program adapted for use by the computer system and printer for preparing and printing postage indicia, addressee information, and sender information onto the postage indicia label, the addressee label, and sender label, respectively, of one of the plurality of the special purpose label arrangement sets;

inputting into the postage computer program information concerning the addressee, the sender, and a mail piece to be mailed; and directing the postage computer program to print the postage indicia, addressee information, and sender information onto the postage indicia label, the addressee label, and the sender label, respectively, of one the special purpose label arrangement sets.

19. The process of claim 18, further comprising the step of obtaining postage value from a postage server.

20. The process of claim 18, wherein the computer system is connected to the postage server through a computer network.

21. The process of claim 18, wherein the step of inputting into the postage computer program information concerning the addressee, the sender, and the mail piece to be mailed is accomplished by at least partially accessing and coordinating data from at least one other computer software program, selected from word processing software, contact management software, database software, and accounting software, and processing this data along with data in the postage computer program.

22. The process of claim 18, wherein the postage indicia, addressee information, and sender information are printed onto the postage indicia label, the addressee label, and the sender label, respectively, of one of the special purpose label arrangement sets in a single pass through the printer.

23. The process of claim 18, wherein the single sheet has a shorter dimension and a longer dimension and the plurality of special purpose label arrangement sets are arranged in a portrait orientation on the single sheet with a plurality of the special purpose label arrangement sets being arranged in a side-by-side orientation on a left side and on a right side of the single sheet.

24. The process of claim 18, wherein in each special purpose label arrangement set, the addressee label is positioned between the postage indicia label and the sender label.

25. The process of claim 18, wherein right side edges other postage indicia label portion, the addressee label portion, and the sender label portion in each set are aligned.

26. The process of claim 18, wherein postage indicia labels printed by the process are adapted for attachment to a mail piece bearing FIM patterns and having a FIM clear zone in such a manner so as not to cover the FIM pattern and not encroach on the FIM clear zone.

27. The process of claim 18, wherein the right side edges of the postage indicia label portion, the addressee label portion, and the sender label portion in each set are aligned, leaving a relief on an upper left side area of the postage indicia label.

28. The process of claim 18, wherein a top region and a right side region of the postage indices label of the sets of the special purpose label arrangement sets are provided pre-printed with fluorescent ink strips.

29. A process for printing, in a single step, postage indicia onto a single sheet containing at east one special purpose label arrangement set with a postage indicia label, the process comprising:

providing a computer system and a printer;

providing a single sheet of a plurality of computer printer printable self-adhesive special purpose label arrangement sets, each special purpose label arrangement set having a postage indicia label having a wider lower region an a narrower upper region, the lower and upper being continuous with the upper region being oriented to a right side of the postage indicia label leaving a relief area on an upper left side area of the postage indicia label, wherein the special purpose label arrangement sets are located on a printable footprint area of the single sheet;

providing a postage computer program adapted for use by the computer system and printer for preparing and printing postage indicia onto the postage indicia label of the special purpose label arrangement set; and inputting into the postage computer program information concerning the mail piece to be mailed; and directing the postage computer program to printing the postage indicia onto the postage indicia label of the special purpose label arrangement set in a single pass through the printer.

30. The process of claim 29, further comprising the step of obtaining postage value from a postage server.

31. The process of claim 30, wherein the computer system is connected to the postage server through a computer network.

32. The process of claim 29, wherein the single sheet of at least one computer printer printable self-adhesive special purpose label arrangement sets further comprises a sender label which is printed with sender information in the same single pass along with the postage indicia label.

33. The process of claim 21, wherein the single sheet of at least one computer printer printable self-adhesive special purpose label arrangement sets further comprises an addressee label which is printed with addressee information in the same single pass along with the postage indicia label and the sender label information.

* * * * *